US009845216B2

(12) United States Patent
Newhouse et al.

(10) Patent No.: US 9,845,216 B2
(45) Date of Patent: Dec. 19, 2017

(54) WEB CONVEYANCE METHOD AND APPARATUS USING SAME

(75) Inventors: Kevin B. Newhouse, Houlton, WI (US); Bruce E. Tait, Woodbury, MN (US); John C. Clark, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 817 days.

(21) Appl. No.: 13/498,058

(22) PCT Filed: Sep. 24, 2010

(86) PCT No.: PCT/US2010/050277

§ 371 (c)(1),
(2), (4) Date: Jun. 4, 2012

(87) PCT Pub. No.: WO2011/038279

PCT Pub. Date: Mar. 31, 2011

(65) Prior Publication Data

US 2012/0241549 A1 Sep. 27, 2012

Related U.S. Application Data

(60) Provisional application No. 61/245,335, filed on Sep. 24, 2009.

(51) Int. Cl.
*B65H 27/00* (2006.01)

(52) U.S. Cl.
CPC ..... *B65H 27/00* (2013.01); *B65H 2404/114* (2013.01); *B65H 2701/1752* (2013.01)

(58) Field of Classification Search
CPC ..... B65H 27/00; B65H 2701/1752; B65H 2404/114
USPC ..... 242/615.4
See application file for complete search history.

(56) References Cited

U.S. PATENT DOCUMENTS

| | | | | |
|---|---|---|---|---|
| 2,411,842 | A | 12/1946 | Adams | |
| 2,451,394 | A | 10/1948 | Klein | |
| 2,478,262 | A | 8/1949 | Gay | |
| 3,308,522 | A | 3/1967 | Miller | |
| 3,588,978 | A | 6/1971 | Brafford | |
| 3,617,445 | A | 11/1971 | Brafford | |
| 3,641,635 | A * | 2/1972 | Martin | 26/2 E |
| 3,707,752 | A | 1/1973 | Brafford | |
| 3,800,381 | A | 4/1974 | Brafford | |
| 3,926,701 | A * | 12/1975 | Nishiwaki | 156/86 |
| 3,948,722 | A | 4/1976 | Wheeldon | |
| 3,993,021 | A | 11/1976 | Kline | |
| 4,043,142 | A * | 8/1977 | Marshall | 66/170 |

(Continued)

FOREIGN PATENT DOCUMENTS

| | | |
|---|---|---|
| DE | 2212452 A * | 1/1977 |
| EP | 1057928 | 12/2000 |

(Continued)

OTHER PUBLICATIONS

International Search Report for PCT/US2010/050277, dated Jan. 21, 2011, 5 pages.

*Primary Examiner* — William E Dondero
(74) *Attorney, Agent, or Firm* — Robert H. Jordan

(57) ABSTRACT

A method for conveying a web using an engagement cover (10) comprising resilient looped pile (16) engagement surface. Also, web conveying roller (12) having an engagement cover thereon.

17 Claims, 6 Drawing Sheets

(56) References Cited

U.S. PATENT DOCUMENTS

| | | | | | |
|---|---|---|---|---|---|
| 4,262,072 | A | | 4/1981 | Wendling | |
| 4,426,757 | A | | 1/1984 | Hourticolon | |
| 4,453,659 | A | | 6/1984 | Torpey | |
| 4,513,042 | A | | 4/1985 | Lumb | |
| 4,531,386 | A | * | 7/1985 | England et al. | 66/202 |
| 4,614,094 | A | * | 9/1986 | Kakihana et al. | 66/170 |
| 4,624,116 | A | | 11/1986 | Rogers | |
| 4,817,639 | A | | 4/1989 | Caudill | |
| 4,838,046 | A | * | 6/1989 | Yasukawa | 66/202 |
| 4,877,669 | A | | 10/1989 | Endrenyi, Jr. | |
| 4,889,271 | A | | 12/1989 | Kurokawa | |
| 4,910,843 | A | | 3/1990 | Lioy | |
| 4,914,796 | A | | 4/1990 | Lioy | |
| 4,970,768 | A | | 11/1990 | Lioy | |
| 4,977,656 | A | | 12/1990 | Lioy | |
| 5,125,246 | A | | 6/1992 | Shytles | |
| 5,142,759 | A | | 9/1992 | Bonander et al. | |
| 5,161,041 | A | | 11/1992 | Abileah | |
| 5,175,030 | A | | 12/1992 | Lu | |
| 5,183,597 | A | | 2/1993 | Lu | |
| 5,286,436 | A | | 2/1994 | Funk | |
| 5,508,879 | A | | 4/1996 | Kitamura | |
| 5,626,512 | A | | 5/1997 | Palaikis | |
| 5,828,488 | A | | 10/1998 | Ouderkirk | |
| 5,919,551 | A | | 7/1999 | Cobb, Jr. | |
| 6,017,831 | A | | 1/2000 | Beardsley | |
| 6,105,899 | A | | 8/2000 | Harris | |
| 6,106,922 | A | | 8/2000 | Cejka | |
| 6,120,864 | A | | 9/2000 | Chiricosta | |
| 6,270,863 | B1 | | 8/2001 | Daecher | |
| 6,277,471 | B1 | | 8/2001 | Tang | |
| 6,280,063 | B1 | | 8/2001 | Fong | |
| 6,425,565 | B1 | | 7/2002 | Montague | |
| 6,471,626 | B1 | | 10/2002 | Kaerger | |
| 6,472,031 | B1 | | 10/2002 | Daecher | |
| 6,668,435 | B2 | | 12/2003 | Wood | |
| 6,759,113 | B1 | | 7/2004 | Tang | |
| 6,830,212 | B1 | | 12/2004 | Harris | |
| 6,884,205 | B2 | | 4/2005 | VanNoy | |
| 6,991,695 | B2 | | 1/2006 | Tait | |
| 7,269,327 | B2 | | 9/2007 | Tang | |
| 7,269,328 | B2 | | 9/2007 | Tang | |
| 7,708,176 | B2 | | 5/2010 | Chuang | |
| 7,780,156 | B2 | | 8/2010 | Schmitz | |
| 2002/0057564 | A1 | | 5/2002 | Campbell | |
| 2002/0114920 | A1 | | 8/2002 | Scholz | |
| 2003/0002896 | A1 | | 1/2003 | Akiba | |
| 2003/0150482 | A1 | | 8/2003 | Kaim | |
| 2005/0003141 | A1 | * | 1/2005 | Zafiroglu | B32B 5/02 428/92 |

FOREIGN PATENT DOCUMENTS

| | | | |
|---|---|---|---|
| GB | 1488949 A | * | 10/1977 |
| JP | S54-123741 | | 8/1979 |
| JP | 60-085954 | | 5/1985 |
| JP | 02-152858 | | 6/1990 |
| JP | 10-204779 | | 8/1998 |
| JP | 2004-26364 | | 1/2004 |
| JP | 2007-125538 | | 5/2007 |
| WO | WO 96-11771 | | 4/1996 |
| WO | WO 97-32805 | | 9/1997 |
| WO | WO 99-18022 | | 4/1999 |
| WO | WO 99-41023 | | 8/1999 |
| WO | WO 00-06470 | | 2/2000 |
| WO | WO 2011-038284 | | 3/2011 |

* cited by examiner

WEB CONVEYANCE METHOD AND APPARATUS USING SAME

CROSS REFERENCE TO RELATED APPLICATIONS

This application is a national stage filing under 35 U.S.C. 371 of PCT/US2010/050277, filed Sep. 24, 2010, which claims priority to Provisional Application No. 61/245,335 filed Sep. 24, 2009, the disclosure of which is incorporated by reference in its/their entirety herein.

FIELD

The present invention relates to a web conveyance or web handling method and apparatus, in particular, methods and apparatuses using rollers presenting a looped pile bearing surface or sleeve thereon.

BACKGROUND

Many products are often manufactured in a continuous web format for the processing efficiencies and capabilities that can be achieved with that approach. The term "web" is used here to describe thin materials which are manufactured or processed in continuous, flexible strip form. Illustrative examples include thin plastics, paper, textiles, metals, and composites of such materials.

Such operations typically entail use of one or more, frequently many more, rollers (sometimes referred to as rolls) around which the web is conveyed throughout the process through a series of treatments, manufacturing steps, etc. Rollers are used for many purposes, including, for example, turning the direction of the web, applying pressure to the web in nip stations, positioning the web for travel through coating and other treatment stations, positioning multiple webs for lamination, stretching webs, etc. Rollers used in such operations are made of a variety of materials, with the selection dependent in large part upon the web(s) being handled, the operational parameters (e.g., speed, temperature, humidity, tension, etc.). Some illustrative examples of materials used to make rollers or covering surfaces thereon include rubber, plastics, metal (e.g., aluminum, steel, tungsten, etc.), foam, felt, and woven fabrics. Specific rollers may be configured to be free rolling, powered (in the same direction the web is traveling or opposite direction, at the same or different speed than the web is traveling, etc.), etc. depending upon the desired tension parameters.

It has been known to texture the surface of rollers to improve web conveyance properties. For example, U.S. Pat. No. 4,426,757 (Hourticolon et al.) and U.S. Pat. Nos. 4,910,843, 4,914,796, and 4,970,768 (all Lioy et al.) disclose forming cavities in the surface of rollers to ameliorate the effects of air carried by fast moving web.

New generation products entail ever more rigorous and precise specifications. Ever more stringent quality control specifications require higher performing processes. Manufacturers using web handling seemingly continually seek higher web processing speeds. The need exists for improved web transport and web handling methods and apparatuses, particularly for use in the high speed, high capacity manufacture and handling of demanding web materials such as optical films and other specialty plastic materials.

SUMMARY

The present invention provides a novel web handling or conveying method and a novel web conveyance apparatus.

The web conveying method and apparatus can be used with a variety of webs. They provide particular advantage when used with fine or high grade films such as optical films in high speed, high capacity industrial scale manufacturing operations. In addition, the present invention provides a novel method for making the novel web conveyance apparatus.

Briefly summarizing, a web conveying method of the invention comprises:

(a) providing a web material;

(b) providing at least one roller having a resilient looped pile engagement surface;

(c) configuring the web material into passing configuration; and (d) passing the web material through engaging contact with the engagement surface.

In brief summary, an apparatus of the invention comprises a roller comprising a core and a resilient looped pile engagement surface as described herein.

Briefly summarizing, a method of making web conveyance apparatus of the invention comprises:

(a) providing a knit fabric comprising a woven base layer having first and second faces and a resilient looped pile protruding from the first face;

(b) applying an elastomeric coating composition to the looped pile; and (c) drying the coating composition to leave a deposit of elastomeric polymer on the looped pile to yield an engagement surface.

The invention has been found to provide many surprising results and advantages, some of which are: 1) reduced scuffing or scratching of a web as it is conveyed over rollers, 2) minimization of high frequency tension and velocity variation of the web as it is conveyed or passes through the conveyance system, 3) cleaning the web during conveyance, and 4) reduced plasticization and/or distortion of the web during conveyance. As a result, web manufacturing operations utilizing the present invention can enjoy such benefits as increased yields with reduced waste, representing significant cost savings and reduced environmental demand.

The invention provides particular advantage in the manufacture of high quality polymeric films, for instance, optical films used for light management applications, e.g., in displays. Illustrative examples include light guides, mirror films, light redirecting films, retarder films, light polarizing films, and diffuser films. In accordance with the invention, such high technology films can be manufactured more effectively with reduced waste, reduced maintenance demands, and reduced cost.

BRIEF DESCRIPTION OF DRAWING

The invention is further explained with reference to the drawing wherein.

Figure 1:
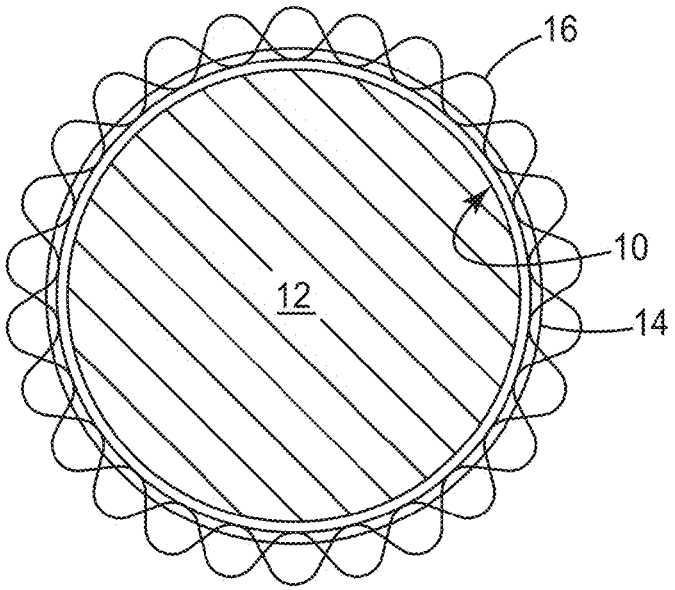
FIG. 1 is cross sectional schematic of one embodiment of a roller with an engagement cover in accordance with the invention.

These figures are not to scale and are intended to be merely illustrative and not limiting.

DETAILED DESCRIPTION OF ILLUSTRATIVE EMBODIMENTS

The following terms are used herein as having the indicated meaning; other terms are defined elsewhere in the specification.

"Convey" is used to mean moving a web from a first position to a second position wherein the web passes through engaging contact with a roller.

"Engaging contact" is used to refer to contact between the web and the roller such that as the web is conveyed it engages with the engagement cover of the roller compressing the cover in response to contact with the web.

"Engagement surface" is the radially outwardly facing portion of the engagement cover that is directly contacted with the web when the web is conveyed.

"Engagement zone" is the portion of the engagement surface that is in direct contact with the web at a particular moment.

"Resilient" is used to refer to the capability of being deformed or compressed and then recovering to earlier shape or loft.

"Web" refers to a flexible, elongate ribbon or sheet of material.

As described above, a method of the invention for conveying a web comprises:

(a) providing a web material;

(b) providing at least one roller having a resilient looped pile engagement surface;

(c) configuring the web material into passing configuration; and (d) passing the web through engaging contact with the engagement surface.

The web material will typically be provided in roll form, e.g., wound upon itself or on a core, but may be provided in other configuration if desired.

The present invention may be used with a wide variety of web materials, illustrative examples including plastics, paper, metal, and composite films or foils.

In some embodiments, the web material is provided from an intermediate storage state, e.g., from an inventory of raw materials and/or intermediate materials. In other embodiments, the web material may be provided to the process of the present invention directly from precursor processing, e.g., such as the take off feed from a film forming process. The web material may be single layer or multilayer, in some instances the invention is used to convey the web material through manufacturing operations in one or more additional layers and/or one or more treatments are applied to a web material.

Configuring the web material into passing configuration simply refers to arranging the web material into position and orientation such that it can be put into engaging contact with the engagement surface of a roller in accordance with the invention. In many embodiments, this will simply comprise unrolling a portion of the web material which is in roll form such that it can be put into engaging contact with the engagement surface. In other illustrative embodiments, the web material is formed in a precursor portion of the operation, i.e., in line, and passed directly into a web conveying apparatus of the invention without having been wound into roll form, e.g., the polymeric material is extruded or cast in line to form a film which, at that point is in passing configuration without ever having been wound into roll form, is the web material conveyed by the apparatus of the invention.

Figure 8:
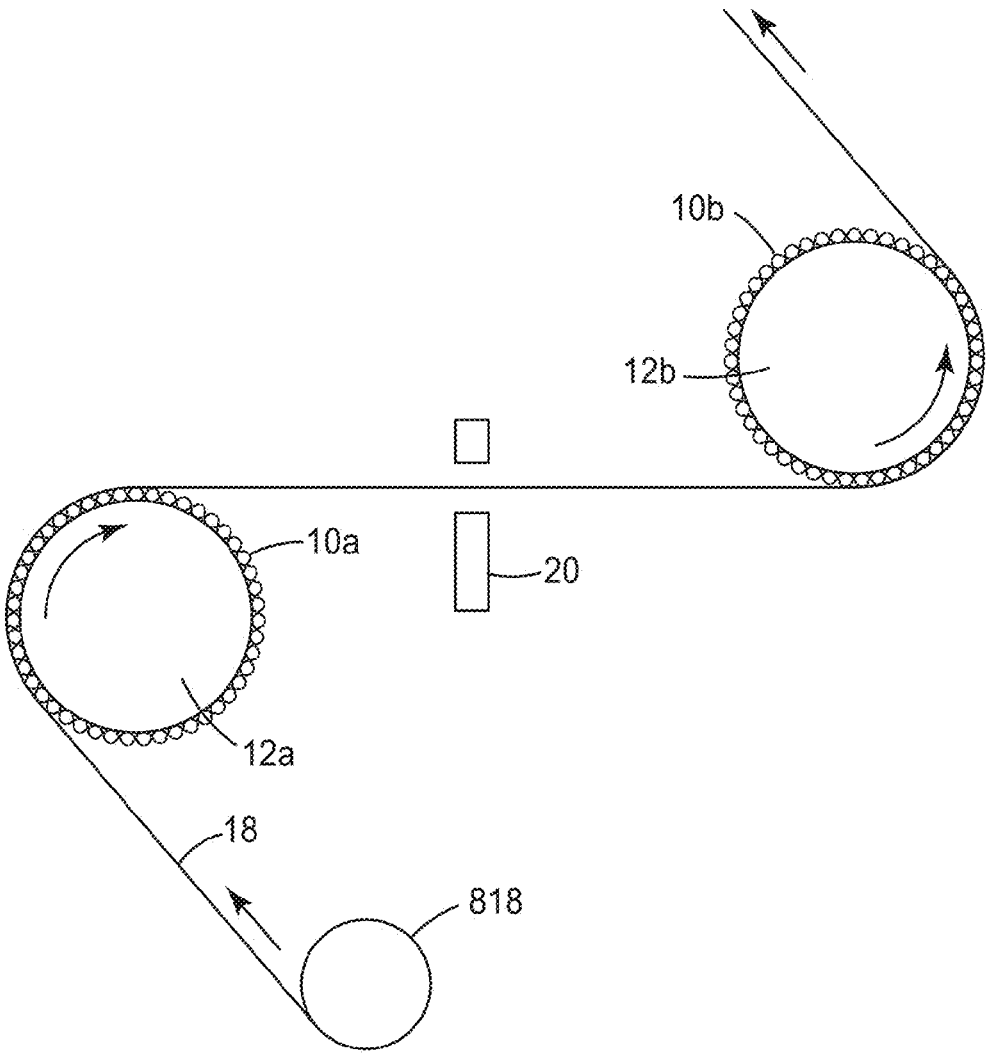
FIG. 8 is a cross section schematic of another embodiment of an apparatus of the invention.
Figure 9:
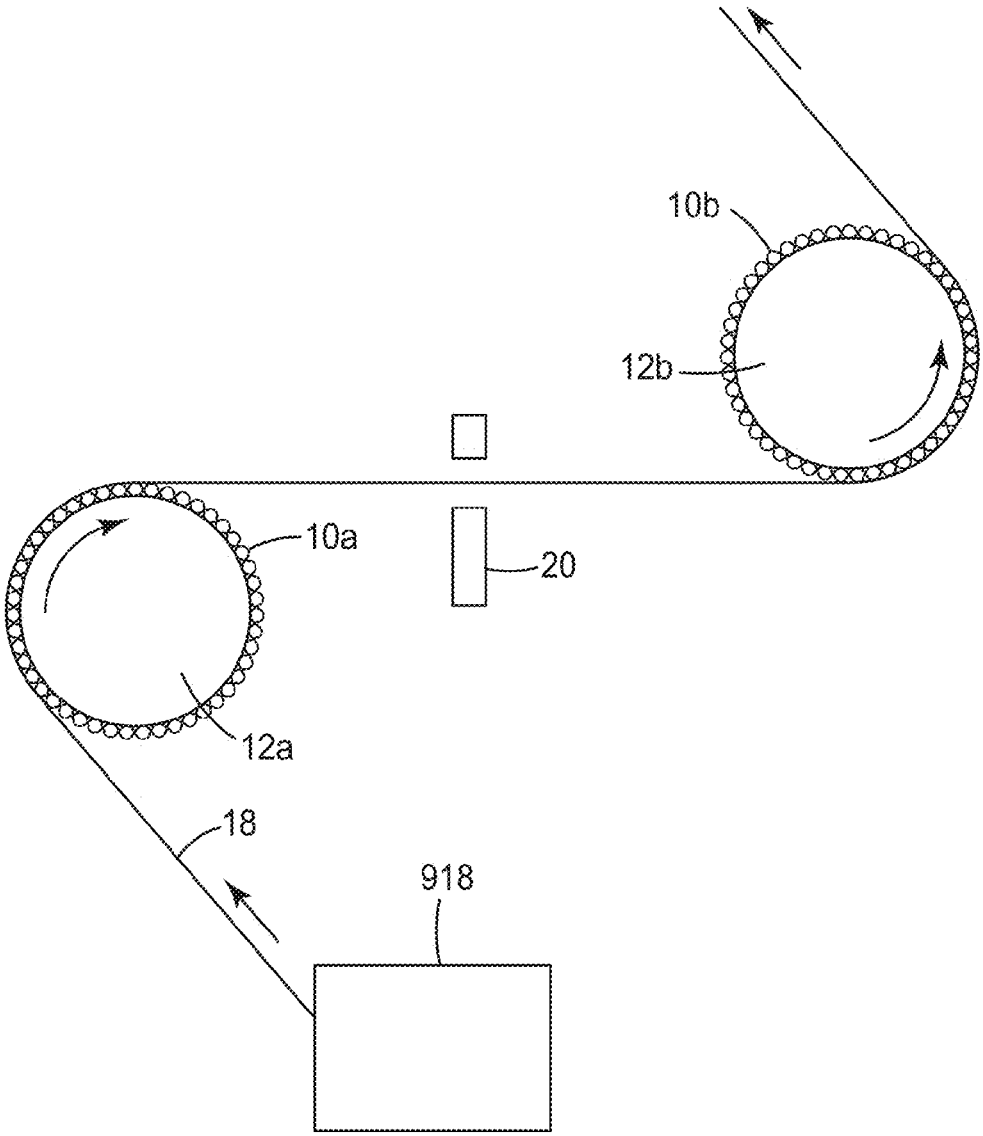
FIG. 9 is a cross section schematic of another embodiment of an apparatus of the invention.

FIG. 8 shows an embodiment of the apparatus of the invention in use wherein web 18 is unrolled from roll 818 and configured into passing configuration to roller 12*a* with engagement cover 10*a* thereon. FIG. 9 shows an embodiment of the apparatus of the invention wherein web 18 is provided from former 818 (e.g., an extruder or casting apparatus) in line with the conveying apparatus without having been wound into roll form.

Next, the web material is conveyed by the apparatus, passing through engaging contact with the engagement surface of a roller of the invention as doing so.

Figure 2:
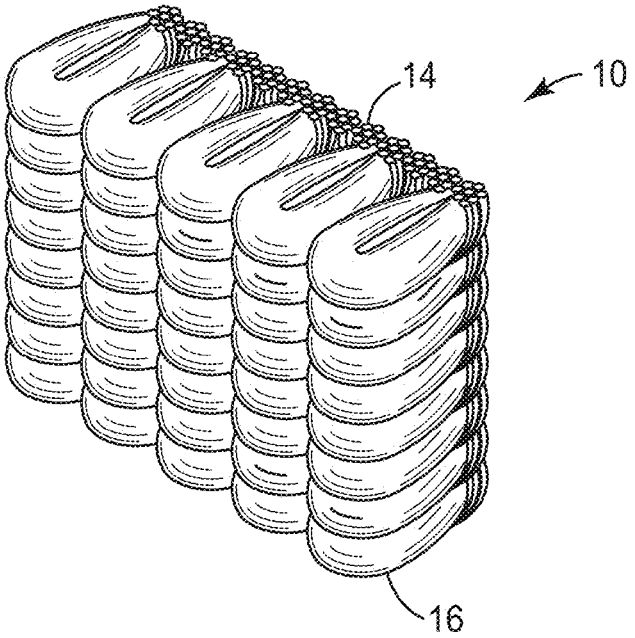
FIG. 2 is a perspective view of a portion of the engagement cover shown in FIG. 1.

An illustrative embodiment of the invention is shown in FIG. 1 wherein is shown engagement cover 10 on roller 12. In the embodiment shown, engagement cover 10 is removable from roller 12 and comprises base or ground layer 14 and looped pile 16 extending upwardly from the first face thereof to form the engagement surface. The second face of layer 14 is in contact with roller 12. A portion of engagement cover 10 is shown in FIG. 2.

Figure 3:
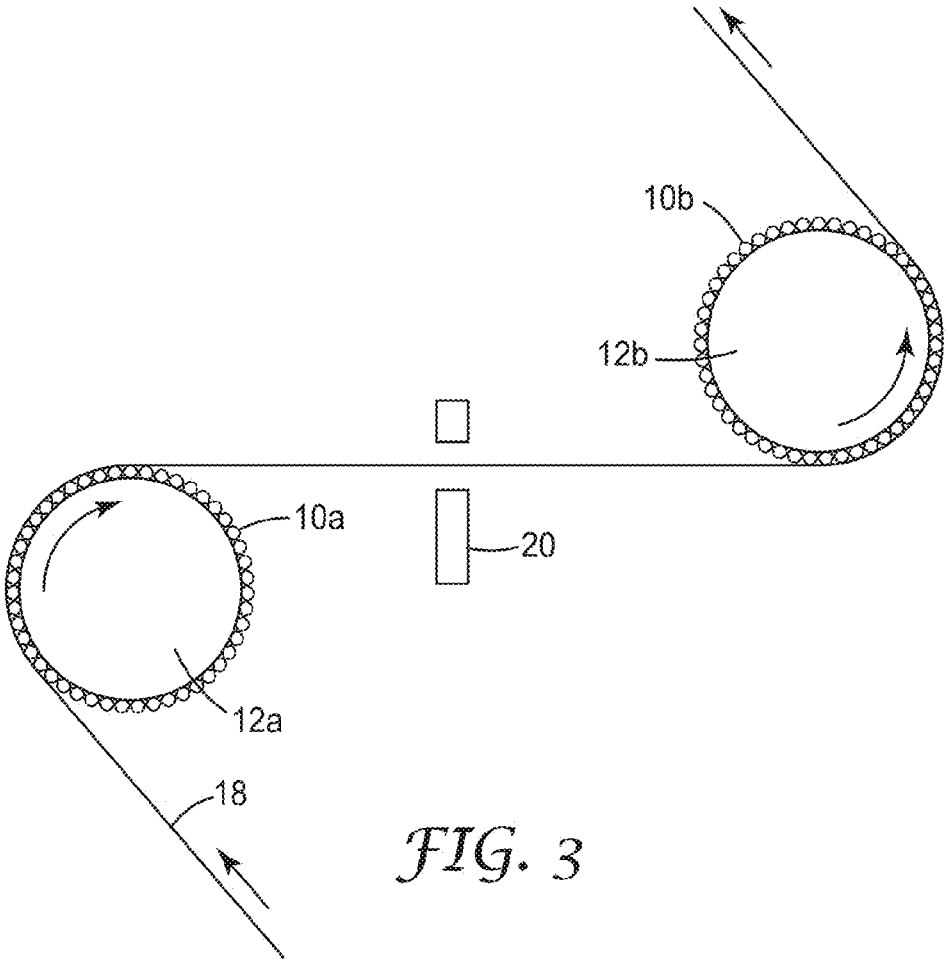
FIG. 3 is a cross section schematic of one embodiment of an apparatus of the invention.

FIG. 3 shows an embodiment of the apparatus of the invention in use wherein is shown web 18 passing over guide roller 12*a* through processing station 20 and over pulling roller 12*b* and on further, e.g., for further processing (not shown) such as application of a coating, lamination to another material, exposure to, etc., or simply wound into roll form. Guide roller 12*a* has engagement cover 10*a* in accordance with the invention and pulling roller 12*b* has engagement cover 10*b* in accordance with the invention.

Depending upon the embodiment, web conveying apparatuses of the invention may comprise one or more rollers with engagement covers of the invention, and may further comprise one or more rollers not equipped with such an engagement cover. Some embodiments will employ dozens or more rollers in sequence, with some, most, or even all of the rollers being equipped with engagement covers of the invention. In embodiments of apparatuses comprising two or more rollers equipped with engagement covers of the invention, the engagement covers may be selected to have different properties to optimize performance at different locations within the manufacturing sequence.

An advantage of the present invention is that typically engagement covers may be readily installed on existing rollers without significant equipment change or significant reconfiguration of apparatus components. Thus, existing web conveying apparatuses may be readily refit with engagement covers of the invention to achieve attendant improvements in performance.

The manner in which the engagement cover is mounted on a roller is dependent upon such factors as the configuration of the apparatus and rollers, e.g., in some instances a roller must be removed from its operational location in order to have an engagement cover mounted thereon whereas in other instances the cover can be installed with the roll in operating position.

During operation, the engagement cover should not slide or stretch on the underlying roller as this can lead to wear of various components of the apparatus, damage to the web, or other impairment of performance. In many instances, when the engagement cover is simply a knit fabric as described herein and has a snug fit to the surface of the underlying roller, the second face of the engagement cover will remain firmly positioned on the roller during operation. In some instances, mounting means such as an intermediate adhesive, mated hook and loop fasteners, rigid shell which attaches to the roller, etc. will be used. In some instances, multiple engagement covers of the invention are installed on a single roller, mounted concentrically on the roller with the engagement surface of each orientated outward or away from the roller.

Figure 7:
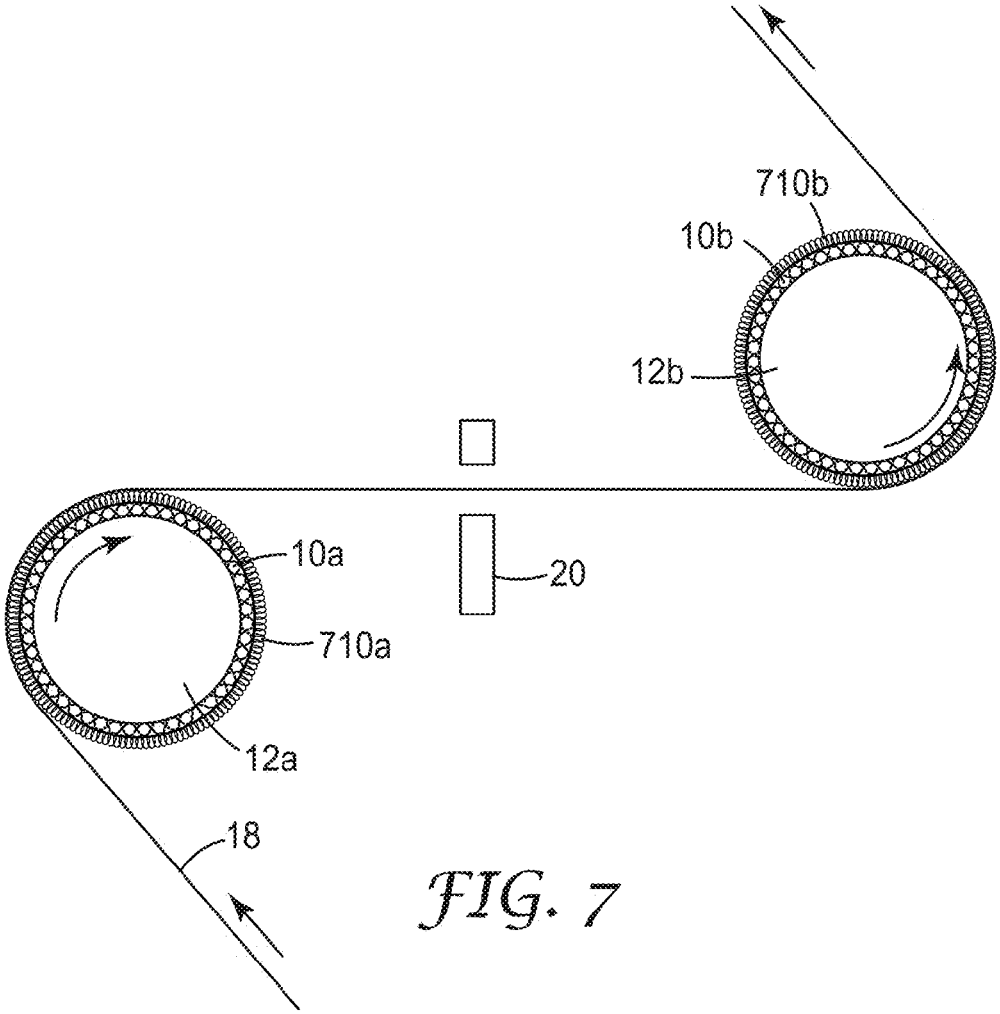
FIG. 7 is a cross section schematic of another embodiment of an apparatus of the invention.

In some embodiments of the invention, one or more rollers may have two or more engagement covers thereon. FIG. 7 shows an embodiment of the apparatus of the invention in use wherein is shown web 18 passing over guide roller 12*a* through processing station 20 and over pulling roller 12*b* and on further to be into roll form. Guide roller 12*a* has engagement cover 10*a* and engagement cover 710*a* mounted in concentric arrangement thereon. Pulling roller 12*b* has engagement cover 10*b* and engagement cover 710*b* mounted in concentric arrangement thereon.

In preferred embodiments, the engagement cover is knit fabric as described herein which is mounted on the roller as a removable sleeve. The sleeve is preferably seamless and should be of appropriate size to fit around roller snugly without developing any loose bulges or ridges. In many embodiments, the sleeve will be configured to extend beyond both ends of the roller sufficiently far that it can be cinched and tied; if the sleeve is of appropriate dimension this action typically tends to pull the sleeve tight. Typically the sleeve should be at least as wide as the web, preferably wider than the web to ease concerns about alignment of the traveling web.

Mounting the engagement cover on the roller may be achieved by conventional means dependent in part upon the nature of the engagement cover and that of the conveying apparatus. Preferably the engagement cover does not slide on the roller core during operation. In many embodiments, the cover is in the form of a sleeve that fits snugly on the roller, optionally extending beyond the ends of the roller sufficiently to be cinched there. In some embodiments, the engagement cover and surface of the roller exhibit sufficient frictional effect, in some instances additional means such as adhesive or hook and loop type fastener mechanisms may be used.

While it is typically desirable for the base of a sleeve of the invention to stretch so as to achieve a snug fit on the roll, the base should not stretch during operation so as to cause bunching underneath the web being conveyed.

Alternatively, rollers may be manufactured with engagement covers as described herein being more strongly attached to the outer surface thereof.

An advantage of removable embodiments is that it will typically be easier and cheaper to replace removable engagement covers on a roller to replace the engagement surface of rather than refinishing a roller having an integrated engagement surface in accordance with the invention.

FIG. 2 illustrates an illustrative embodiment wherein engagement cover 10 comprises base 14 and looped pile 16 on the first face thereof.

In a typical embodiment, the cover is made with a knit fabric having a pile-forming loop at every stitch. In an illustrative embodiment there are 25 stitches per inch (1 stitch per millimeter). The fibrous material(s) used to make the fabric may be single filament strands, multifilament strands (e.g., two or more strands wound together to yield a single thread), or combinations thereof.

In many embodiments, the looped pile has a loop height (i.e., dimension from the plane defined by the top of the base layer to the apex of the pile loops) of from about 0.4 to about 0.8 mm, preferably from about 0.5 to about 0.7 mm. It will be understood that engagement covers having looped pile having loop heights outside this range may be used in certain embodiments. If the loop height is insufficient, the cover may fail to provide effective cushioning effect to the web to achieve the full benefits of the invention. If the loop height is too high, the pile may tend to get floppy and undesirably affect web transport or damage the conveyed web.

The pile should be sufficiently dense to be supportive of the web during conveying so as to reliably achieve the benefits of the invention. For instance, the looped pile comprises fibers selected to have an appropriate denier for the application, with thicker fibers providing relatively greater resistance to compression. Illustrative examples include fibers having a denier from about 100 to about 500. As will be understood, fibers having a denier outside this range may be used in some embodiments in accordance with the invention.

While we do not wish to be bound by this theory, it is believed that when used as described herein engagement surfaces of the invention reduce or eliminate the Know-Sweeney Air Boundary layer that would otherwise form between the web and surface of the rolls. Moreover, the resiliency introduced into the system by the pile layer significantly reduces or dampens the velocity and/or tension variability that the web is subjected to during conveying. As a result, the invention permits webs to be conveyed and handled in fast, high efficiency settings without scuffing the surface or imparting property-degrading changes thereto. For instance, when subjected to the stresses encountered in typical high speed, high tension operations, some polymeric web materials such as polyesters may undergo plasticization and/or distortion that impair their desired optical or physical properties. We have surprisingly found that using roller covers in accordance with the present invention minimizes these deleterious effects.

In illustrative embodiments, the fibrous material(s) are selected from the group consisting of poly(tetrafluoroethylene) (PTFE such as, e.g., TEFLON® fiber), aramid (e.g., KEVLAR®), polyester, polypropylene, nylon, or combinations thereof. Those skilled in the art will be able to readily select other fibers which can be effectively knit and used in covers of the invention.

The base is typically knit so as to provide the desired properties to permit it to be placed on a roller and used in accordance with the invention, e.g., stretch and slide sufficiently easily over the roll to permit it to be installed while not stretching undesirably during operation.

Some illustrative examples of materials that can be used as sleeves to make engagement covers of the invention include: HS4-16 and HS6-23 polyester sleeves from Syfilco Ltd., Exeter, Ontario, Canada; WM-0401C, WM-0601, and WM-0801 polyester sleeves from Zodiac Fabrics Company, London, Ontario, Canada or its affiliate Carriff Corp., Midland, N.C.; and BBW3310TP-9.5 and BBW310TP-7.5 sleeves from Drum Filter Media, Inc., High Point, N.C.

Typically knit fabrics are made using fibrous materials that have been treated with lubricants to facilitate the weaving process. When the resultant knit fabrics are used in web conveyance operations in accordance with the invention, such lubricants may tend to wear away causing variation in frictional performance to the web and potential contamination issues. Accordingly, it is typically preferred to wash or scour fabrics used as roller covering herein.

The material(s) selected should be compatible with the web materials and operating conditions, e.g., stable and durable under the ambient operating conditions, e.g., temperature, humidity, materials present, etc. It has been observed that, if the engagement cover material(s) are of contrasting color to the web materials, observation of debris capture by the engagement cover is facilitated, e.g., using black polyester fibers in an engagement cover to be used with a transparent film web.

Typically, because of the requirements of the knitting processes used to make them, knit fabrics are made with fibrous materials that have limited elastomeric character so that the fibers can be moved around in contact with one another to form the desired weave. In many instances, lubricants are applied to the fibers to facilitate the knitting process. It is preferred to remove such lubricants from knits used in the present invention, e.g., by cleaning or scouring the material such as by washing it before using it. In some instances, the knit can be put into service as an engagement surface of the invention with a lubricant being worn away.

Typically it is preferred that the loop pile of the engagement cover provide a coefficient of friction to the web of from about 0.25 to about 2, with about 1.0 or more often being preferred, though engagement covers providing coefficients of friction outside this range may be used if desired.

The degree of grip or coefficient of friction ("COF") which is desired of the engagement surface to the web is dependent in part upon the function of the subject roller. For instance, in the case of an idler roller or other roller operating under little tension differential (i.e., a lesser difference between $T_1$ and $T_2$ in the Belt Equation discussed below), a lower COF is typically satisfactory. In the case of driven rollers, especially highly driven rollers operating under a large tension differential (i.e., a significant difference between $T_1$ and $T_2$) a higher COF is typically desired.

In some cases, in order to be able simultaneously achieve desired frictional properties with web, abrasion resistance, radial modulus of elasticity, and resilience of the loop pile, quantities of selected polymeric relatively elastomeric (as compared to the fibrous pile material(s)) materials can be applied to the engagement surface to form grip enhancement elements that raise the effective COF between the engagement surface and web. We have found that when elastomeric elements are used that improved performance is achieved if the elastomeric elements have a Shore A hardness of less than about 75, sometimes from about 30 to about 60, and preferably from about 30 to about 45. Typically, it is preferred that the grip enhancement elements are provided as an array of discrete elements on the pile.

Briefly summarizing, such enhanced embodiments of engagement covers of the invention are made by:

(a) providing a knit fabric comprising a woven base layer having first and second faces and a resilient looped pile protruding from the first side;
(b) applying an elastomeric coating composition to the looped pile, preferably after having washed or scoured it to remove any debris and/or lubricants therefrom; and
(c) optionally removing excess quantities of elastomeric coating composition to leave discontinuous deposits thereon on the looped pile; and
(d) curing the coating composition to leave one or more grip enhancement elements on the looped pile to yield the engagement cover.

Depending upon the elastomeric material(s) selected, curing may be achieved by drying to remove solvent or other liquid carrier, crosslinking by exposure to actinic radiation (e.g., heat, e-beam, ultraviolet, etc.), crosslinking by action of chemical crosslinker, or combinations thereof.

In some embodiments, the elastomeric coating composition comprises one or more elastomeric polymers dissolved in one or more solvent(s).

Illustrative examples of elastomeric polymers that can be used to form grip enhancement elements include those selected from the group consisting of KRATON™ polymers (e.g., styrenes), urethanes, acrylics, silicones, olefins, and copolymers, block copolymers, and other combinations thereof.

A suitable solvent can be readily selected by those skilled in the art with the solvent or combinations of solvent being chosen for effectiveness in dissolving the elastomeric polymer(s), compatibility with the loop pile and base layer of the knit, convenience of use, and drying performance. Illustrative examples include but are not limited to the group consisting of xylene, toluene, isopropanol, methyl ethyl ketone, and combinations thereof.

In some embodiments the elastomeric coating composition comprises from about 10 percent by weight to about 50 percent by weight of the elastomeric polymer(s). It will be understood that coating compositions with thinner or thicker concentrations can be used if desired.

In some other embodiments, the elastomeric coating composition comprises a water-based emulsion of the elastomeric polymer(s).

In still other embodiments, the elastomeric coating compositions are crosslinked to yield the desired deposits or gripping enhancement elements.

The elastomeric coating composition containing the one or more elastomeric polymers is applied to the loop pile. Any suitable method of application can be used and can be readily selected by those skilled in the art, e.g., such as some method of dipping, coating, or spraying.

Depending upon how much coating composition is applied to the loop pile, it may be desirable to remove some quantity therefrom to achieve a desired final deposit amount. For instance, typically an array of discrete, unconnected elements disposed on the surface of the pile is preferred. Illustrative examples of methods of removal include wiping, squeegee, doctor blade, passing through a nip, etc. to yield the desired degree and arrangement of deposits.

After application, the coating composition is cured in situ to leave the desired grip enhancement elements. In typical embodiments, the amount of the resultant elastomeric coating constituting the grip enhancement elements is equivalent to from about 5 weight percent to about 50 weight percent of the weight of the loop pile, typically preferably from about 5 to about 20 weight percent, with an amount of about 10 weight percent typically being most preferred. If the elastomeric coating is too sparing, then the desired improvement in coefficient of friction with the web will not be achieved. If the elastomeric coating is too heavy, then the loop pile may be too matted to provide desired resilient support leading to marring or other damage of the web, portions of the coating may tend to dislodge during use and contaminate the web or otherwise impair web conveyance.

Deposition of elastomeric polymer onto the loop pile may be carried out either before or after the engagement cover is installed on a roller.

Figure 5:
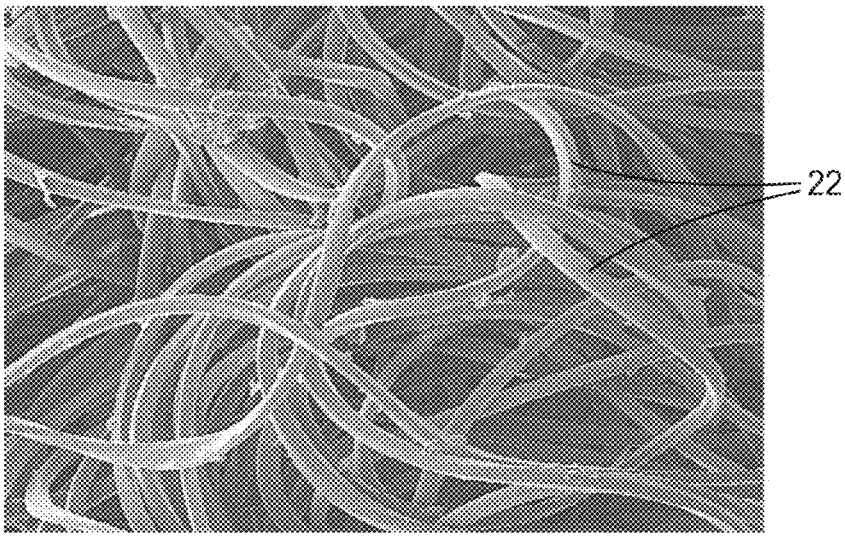
FIG. 5 is a photograph of one embodiment of the loop pile of an engagement cover of the invention.
Figure 6:
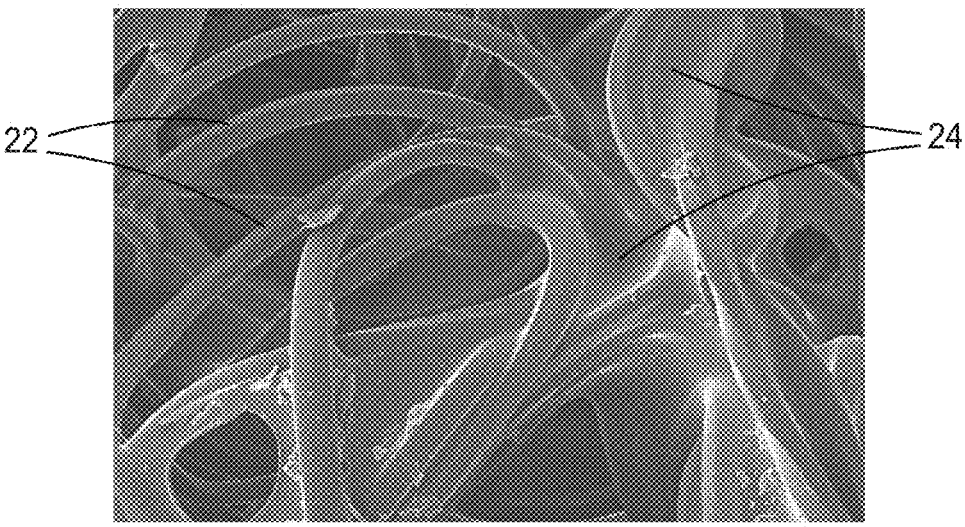
FIG. 6 is a photograph of another embodiment of the loop pile of an engagement cover of the invention.

FIG. 5 shows an illustrative loop pile of an engagement cover of the invention wherein pile fibers 22 are visible. FIG. 6 shows, at a larger magnification, an illustrative loop pile of an engagement cover of the invention after elastomeric polymer has been deposited thereon with fibers 22 and deposits 24 being visible.

Figure 4:
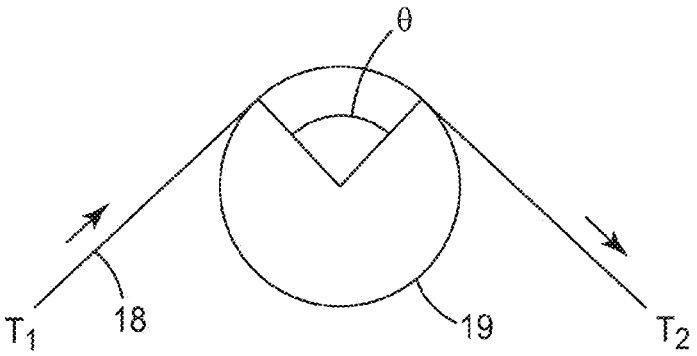
FIG. 4 is a schematic illustration of the tension profile of a web being conveying over a roller.

By engaging contact with the roller it is meant that the web contacts the engagement surface of the roller over an arcuate portion referred to as the engagement zone with sufficient pressure so as to at least partially compress the loop pile. In such arrangement, the tension of the web on one side of the roller is different from that on the other side of the roller. With reference to FIG. 4, the relationship of the tension of the web on either side of the subject roller and to the properties of the engagement surface of the roller may be understood through what is sometimes referred to as the Belt Equation:

$$T_2=T_1\times e^{\theta\mu}$$

where $T_1$ is the tension of the web approaching the roller, $T_2$ is the tension of the web leaving the roller, $\theta$ is angular width of the engagement zone in radians, and $\mu$ is the coefficient of friction between the engagement surface of the roller and the surface of the web.

The invention may be used with known web transport rollers, including for example, rubber rollers, metal rollers (e.g., aluminum, steel, tungsten, etc.), and composite rollers. The invention may be used on rollers configured for any variety of different functions including but not limited to unwind rollers, tension control rollers, guide rollers, idler rollers, pull rollers, vacuum pull rollers, driven rollers, nip rollers, coater back-up rollers, etc. Rollers using the invention may be solid or hollow and may include such apparatus to apply vacuum effects, heating the web, cooling the web, etc.

As noted above, in some instances, apparatus will be comprise rollers with multiple engagement covers of the invention installed thereon, mounted concentrically on a roller. This may be done to yield a thicker cushion depth, thus increasing the dampening effect of the engagement cover(s). Also, in some instance, particularly in large industrial settings, significantly more effort is required to install an engagement cover on a roller than is necessary to remove it from the roller. Thus, if multiple engagement covers are installed on a roller, once the outer one is contaminated and/or worn from use, the outer engagement cover can be removed to expose an underlying engagement cover of the invention for significantly less cost and effort than freshly installing a new cover.

The invention can be used in connection with a wide variety of web materials. It is well suited and can provide particular advantage in connection with the manufacture and handling of webs of high quality polymeric materials such as optical films. Such films, typically comprising one or more layers of select polymeric materials, e.g., radiation-cured compositions, typically require precise and uniform specifications of width, thickness, film properties, etc. with very low defect rates. The web material may be of monolayer or multilayer construction.

Illustrative examples of optical films that can be made using the present invention include such films are disclosed in U.S. Pat. No. 5,175,030 (Lu et al.), U.S. Pat. No. 5,183,597 (Lu), U.S. Pat. No. 5,161,041 (Abileah), U.S. Pat. No. 5,828,488 (Ouderkirk et al.), U.S. Pat. No. 5,919,551 (Cobb et al.), U.S. Pat. No. 6,277,471 (Tang), U.S. Pat. No. 6,280,063 (Fong), U.S. Pat. No. 6,759,113 (Tang), U.S. Pat. No. 6,991,695 (Tait et al.), U.S. Pat. No. 7,269,327 (Tang), U.S. Pat. No. 7,269,328 (Tang), and U.S. Patent Appln. Publn. No. 2002/0057564 (Campbell et al.).

As is known to those skilled in the art, such films may be made of many known suitable materials, e.g., a mixture of radiation cured mono and multifunctional (meth)acrylate monomers, and manufactured according to known techniques, e.g., microreplication processes. Illustrative examples include such monomers as poly(meth)acryl monomers selected from the group consisting of (a) mono(methacryl) containing compounds such as phenoxyethyl acrylate, ethoxylated phenoxyethyl acrylate, 2-ethoxyethoxyethyl acrylate, ethoxylated tetrahydrofurfural acrylate, and caprolactone acrylate, (b) di(meth)acryl containing compounds such as 1,3-butylene glycol diacrylate, 1,4-butanediol diacrylate, 1,6-hexanediol diacrylate, 1,6-hexanediol monoacrylate monomethacrylate, ethylene glycol diacrylate, alkoxylated aliphatic 30 diacrylate, alkoxylated cyclohexane dimethanol diacrylate, alkoxylated hexanediol diacrylate, alkoxylated neopentyl glycol diacrylate, caprolactone modified neopentylglycol hydroxypivalate diacrylate, caprolactone modified neopentylglycol hydroxypivalate diacrylate, cyclohexanedimethanol diacrylate, diethylene glycol diacrylate, dipropylene glycol diacrylate, ethoxylated (10) bisphenol A diacrylate, ethoxylated (3) bisphenol A 5 diacrylate, ethoxylated (30) bisphenol A diacrylate, ethoxylated (4) bisphenol A diacrylate, hydroxypivalaldehyde modified trimethylolpropane diacrylate, neopentyl glycol diacrylate, polyethylene glycol (200) diacrylate, polyethylene glycol (400) diacrylate, polyethylene glycol (600) diacrylate, propoxylated neopentyl glycol diacrylate, tetraethylene glycol diacrylate, tricyclodecanedimethanol diacrylate, triethylene glycol 10 diacrylate, tripropylene glycol diacrylate; (c) tri(meth)acryl containing compounds such as glycerol triacrylate, trimethylolpropane triacrylate, pentaerythritol triacrylate, ethoxylated triacrylates (e.g., ethoxylated (3) trimethylolpropane triacrylate, ethoxylated (6) trimethylolpropane triacrylate, ethoxylated (9) trimethylolpropane triacrylate, ethoxylated (20) trimethylolpropane triacrylate), propoxylated triacrylates (e.g., propoxylated (3) glyceryl 15 triacrylate, propoxylated (5.5) glyceryl triacrylate, propoxylated (3) trimethylolpropane triacrylate, propoxylated (6) trimethylolpropane triacrylate), trimethylolpropane triacrylate, tris(2-hydroxyethyl) isocyanurate triacrylate; (d) higher functionality (meth)acryl containing compounds such as pentaerythritol tetraacrylate, ditrimethylolpropane tetraacrylate, dipentaerythritol pentaacrylate, ethoxylated (4) pentaerythritol tetraacrylate, caprolactone 20 modified dipentaerythritol hexaacrylate; (e) oligomeric (meth)acryl compounds such as, for example, urethane acrylates, polyester acrylates, epoxy acrylates; polyacrylamide analogues of the foregoing; and combinations thereof. Such compounds are widely available from vendors such as, for example, Sartomer Company of Exton, Pa.; UCB Chemicals Corporation of Smyrna, Ga.; and Aldrich Chemical Company of 25 Milwaukee, Wis. Additional useful (meth)acrylate materials include hydantoin moiety-containing poly(meth)acrylates, for example, as described in U.S. Pat. No. 4,262,072 (Wendling et al.).

In some embodiments, the web is a simple film, e.g., of polyester (e.g., photograde polyethylene terephthalate and MELINEX™ PET from DuPont Films) or polycarbonate. In some embodiments, the film comprises such materials as, for example, styrene-acrylonitrile, cellulose acetate butyrate, cellulose acetate propionate, cellulose triacetate, polyether sulfone, polymethyl methacrylate, polyurethane, polyester, polycarbonate, polyvinyl chloride, polystyrene, polyethylene naphthalate, copolymers or blends based on naphthalene dicarboxylic acids, polycyclo-olefins, and polyimides.

It has been surprisingly found that by providing web transport/handling rolls with engagement covers as described herein that significant performance advantages can be obtained. Certain high value web materials, e.g., optical films, are characterized by a high modulus, stiff character. As a result, the webs do not resist stretching and during web transport are subject to scuffing or even breaking when they slip over rollers in response to jerking forces encountered through the web line. In addition, the web material may undergo undesirable changes to its bulk properties in response to such force, e.g., undergoing plasticization upon exceeding its yield point so as to become baggy. Such changes may make the resultant material less acceptable for ultimate use, e.g., making it difficult to work with, impairing uniformity of optical properties, etc.

The engagement covers described herein have a low radial modulus of elasticity with enhanced tribological characteristics. As a result, the invention provides a convenient, low cost way to reduce undesirable effects on the web during web transport and handling.

The engagement covers provide a compliant low radial modulus of elasticity character to the roller surface which compensates for many perturbations encountered in a complex web transport system, e.g., tension variations and speed variations, due to any of a myriad of causes, e.g., variation in web properties such as thickness, modulus, etc., variations in performance or characteristics of individual rolls in a system comprising many rolls, power fluctuations in drive rolls, and the like. In accordance with the invention, the covers enable the web to avoiding buckling and wrinkling when it otherwise might. In addition, the cover has been found to dampen velocity and tension variability of the web as it travels through the web line. As a result, high quality webs, e.g., optical grade webs, can be processed at high speeds, e.g., 100 fpm, 150 fpm, 170 fpm, or more, with reduced web degradation, e.g., buckling, scuffing, etc. Furthermore, the pile construction is believed to entrap contamination, e.g., dirt particles, that would otherwise damage the web being processed.

The invention may be used on web transport apparatus having just one or two rolls, or systems having many more rolls. Covers of the invention may be used on one or two selected rolls in a system or in many rolls throughout the system as desired.

The manufacturing operation may include formation of the web, then treatment of the web, e.g., application of primers, additional optical layers, adhesives, colorants, etc. The present invention provides means for carrying out such operations in a technically effective, cost efficient manner.

EXAMPLES

The invention will be further explained with reference to the following illustrative examples.

Example 1

23 of the rollers on a production-scale, commercial, biaxially oriented PET film line were fitted with resilient looped pile engagement covers exemplary of the present invention. Roller types tested included idler rollers, coater back-up rollers, and pull rollers.

Five different types of circular-knit stock in the appropriate diameters was obtained from Syfilco, Ltd. (Exeter, Ontario, Canada) for use as engagement covers as follows:

PET-HS6: looped pile sleeve with a 6-inch diameter (15 cm) made of 150 denier polyethylene terephthalate fibers, and a loop height of 0.7 mm.

PET-HS4: looped pile sleeve with a 4-inch (10 cm) diameter made of 150 denier polyethylene terephthalate fibers, and a loop height of 0.7 mm.

POLYPROPYLENE: looped pile sleeve with a 6-inch (15 cm) diameter made of polypropylene fiber, and a loop height of 0.5 mm.

PTFE-400-HS6: looped pile sleeve with a 6-inch (15 cm) diameter made of 400 denier polytetrafluoroethylene fibers, and a loop height of 0.6 mm.

PTFE-200-HS6: looped pile sleeve with a 6-inch (15 cm) diameter made of 200 denier polytetrafluoroethylene fibers, and a loop height of 0.6 mm.

The rollers on the line that were fitted with engagement covers of the invention were selected to represent a variety of roller materials and functional types. Some rollers were fitted with one engagement cover, and some were fitted with two covers, one cover having been pulled over the other as indicated. Table 1 gives a summary of the roller materials and engagement cover materials

TABLE 1

| Roller | | | Engagement Cover | |
|---|---|---|---|---|
| Function | | | | |
| No. | Type | Material | Inner | Outer |
| 1 | Idler | Aluminum | N/A | PTFE-400-HS6 |
| 2 | Idler | Rubber | POLYPROPYLENE | PTFE-200-HS6 |
| 3 | Coater Back-Up | Carbon-Fiber Composite | N/A | PET-HS4 |
| 4 | Idler | Aluminum | N/A | PET-HS6 |
| 5 | Pull | Rubber | PET-HS6 | PTFE-400-HS6 |
| 6 | Pull | Aluminum | POLYPROPYLENE | POLYPROPYLENE |
| 7 | Pull | Rubber | N/A | PTFE-200-HS6 |
| 8 | Pull | Rubber | N/A | PTFE-200-HS6 |
| 9 | Idler | Aluminum | N/A | POLYPROPYLENE |
| 10 | Idler | Aluminum | PET-HS6 | PET-HS6 |
| 11 | Pull | Rubber | PET-HS6 | PTFE-200-HS6 |
| 12 | Idler | Rubber | PET-HS6 | PTFE-400-HS6 |
| 13 | Coater Back-Up | Carbon-Fiber Composite | PET-HS6 | PTFE-400-HS6 |
| 14 | Idler | Aluminum | N/A | PET-HS4 |
| 15 | Idler | Aluminum | N/A | PET-HS6 |
| 16 | Idler | Aluminum | PET-HS6 | PET-HS6 |
| 17 | Idler | Carbon-Fiber Composite | PET-HS6 | PTFE-200-HS6 |
| 18 | Idler | Aluminum | PET-HS6 | PTFE-400-HS6 |
| 19 | Idler | Tungsten | PET-HS6 | PTFE-400-HS6 |
| 20 | Idler | Tungsten | PET-HS6 | PTFE-400-HS6 |
| 21 | Idler | Aluminum | PET-HS6 | PTFE-400-HS6 |
| 22 | Idler | Aluminum | PET-HS6 | PTFE-200-HS6 |
| 23 | Pull | Rubber | N/A | PTFE-200-HS6 |

The film line was run for four days. The film was monitored for scratching and scuffing, which was a significant cause of rejected product rolls from this film line when run without engagement covers of the invention. The roller engagement covers were monitored for wear, stretch, and any build-up of foreign material on the looped pile engagement surface.

No build-up of foreign material from abrasion was observed on any of the engagement covers. However, the looped pile engagement covers were observed to attract particulate debris, but seemed to sequester this debris from causing any scratching to the passing film. Occasionally small holes or tears in the engagement covers were observed due to such debris, but no deterioration of performance due to these holes or tears was observed. Some of the engagement covers stretched in the axial direction with use, especially in the first hour or so of use. Stretching was most significant for pull rolls and for rolls on which the film tension was relatively high. Stretching was not limited to any particular one of the cover materials. The POLYPROPYLENE engagement covers exhibited a minor amount of pile flattening after four days use, but still functioned to eliminate scratch and scuff. Some of the rollers with 200 denier PTFE cover exhibited a small amount of fiber breakage resulting in some fraying of the looped pile. The 400 denier PTFE exhibited very little fraying. The PET cover materials showed no visible signs of wear. There appeared to be no difference between the performance of single-covered rollers and double-covered rollers.

Film scuffing and scratching was greatly reduced as a result of using the looped pile engagement covers. None of the covered rollers were observed to cause visible increases in scratching, even those that trapped significant amounts of particulate debris. Historically, this film line exhibits a rate of roll rejection for scratch and scuff of the roll-facing sides of the web of approximately 4.5% of the total of all product roll rejections. This value sometimes ranged as high as 7% of all roll rejections, and very rarely fell below 2.5%. The number of roll rejections for scratch and scuff in this trial was only 1.7% of all product roll rejections.

Example 2

The same film line was used as in Example 1. By trial and error, additional rollers were covered with selected looped pile engagement covers until most of the rollers were so covered, and diminishing returns in the decrease of the rate of roll rejection due to scuff and scratch were observed. A rate of product roll rejection for scuff and scratch of less than 0.5% of all product roll rejections, per month, was observed over five consecutive months. The same film line, operated without looped pile roller covers, had never previously experienced a single month with a rate of product roll rejection for scuff and scratch below 0.6% of all product roll rejections.

Examples 3 to 20

In these Examples, one of the same circular-knit stocks used in Example 1, PET-HS6, was used interchangeably with a circular-knit stock designated FT-10201 from Zodiac Fabrics Co. (London, Ontario, Canada) as engagement covers. FT-10201 was a looped pile sleeve with a 2-inch (5 cm) diameter made of polyethylene terephthalate fiber.

For each of Examples 3 to 20, a rectangular swatch was cut from the tubular stock. The swatch of Example 3 was then tested to determine its dynamic sliding coefficient of friction against biaxially-oriented PET film using an IMASS, Inc. (Accord, Mass., USA) Slip/Peel Tester Model SP-102B-3M90. The test was performed in accord with the instrument manual with the exception that the testing apparatus's 200 g sled was augmented with a 1000 g added weight due to the fluffy nature of the looped pile fabric being tested. The apparatus was capable of recording dynamic coefficient of friction ("COF") in the range between about 0.1 and about 2.0.

The swatch of Example 3 exhibited a COF of 0.5. However, it was observed while doing replicate runs that the COF of the uncoated swatch declined with repeated testing and continued to decline until reaching a plateau level of a COF of about 0.3. It was determined that this effect was due to the fact that the stock materials, as received, includes a trace of a lubricant oil that is used on the fibers to aid in the knitting into looped pile fabric. Presumably this oil transfers gradually with repeated test runs to the PET film as well and with both surfaces thus lubricated the COF is reduced.

For Example 4, a replicate swatch of the same stock was used. This fabric swatch was dipped into a series of solvent baths to wash off the lubricant oil. The baths contained ethyl acetate, acetone, isopropyl alcohol, and finally water. After drying, the resulting fabric was tested for COF in a manner identical to that of Example 3. The swatch of Example 4 exhibited a COF of about 0.5 and this result persisted over 50 replicate measurements.

For Examples 5 to 20, each PET fabric swatch was bathed to remove lubricant oil as in Example 4. Gripping enhancement elements were then formed on each as follows. A solution of the polymer to be coated onto the PET looped pile fabric was prepared at 10 percent by weight using either toluene or a 70:30 blend of toluene and isopropyl alcohol, as indicated, depending on the polymer to be coated. Details are given in Table 2. The swatch was dipped in the indicated coating solution to effectively saturate the looped pile surface of the fabric. The solution was readily imbibed by the fabric, resulting in effective deposition of the elastomeric material on the backside of the base fabric as well. The solvent was then allowed to evaporate from the coated fabric at room temperature. The last of the solvent was driven off by heating in an oven at 100° C. The result in each case was a looped pile fabric in which the individual and intersecting PET fibers were coated with a second polymer, and this was confirmed by observation under optical and electron microscopes as shown in FIG. 6. Weighing the specimens revealed that the coated polymer was added to the PET fiber at about 15 to 20 percent by weight.

Each of the swatches was then tested to determine its dynamic sliding coefficient of friction against biaxially oriented PET film, using the same apparatus and procedures as in Example 3. Table 2 shows the Polymer being coated, the general Chemistry of the polymer, the Solvent used, and the COF measured. It was observed that it was possible to make coated looped pile fabrics with a wide range of COF, from roughly the same as the uncoated PET looped pile fabric, i.e., about 0.5, to greater than 2.0.

All KRATON™ block copolymers were obtained from Kraton Polymers LLC (Belpre, Ohio, USA). QUINTAC™ 3620 was obtained from Zeon Chemicals LP (Louisville, Ky., USA). VECTOR™ 8508A was obtained from Dexco Polymers LP (Houston, Tex., USA). Both LUBIZOL™ ESTANE™ polymers were obtained from The Lubrizol Corp. (Wickliffe, Ohio, USA). SBR Rubber was obtained from Dynasol Elastomeros SA de CV (Altamira, Mexico). NORDEL™ EPDM 4570 was obtained from Dow Chemical Co. (Midland, Mich., USA). HUNTSMANT™ IROGRAN™ 160E-4902 was obtained from Huntsman LLC (Auburn Hills, Mich., USA).

For many of these materials, the Shore A Hardness value has been published; these values are also reported in Table 2.

A general correlation between the Shore A Hardness of the elastomer used for the gripping enhancement elements and the resultant COF of the coated looped pile fabric was observed, with the COF tending to rise as the Shore A Hardness declines.

TABLE 2

| Ex. | Polymer | Chemistry | Solvent | COF | Shore A Hardness |
|---|---|---|---|---|---|
| 5 | KRATON ™ D1111K | Styrene-Isoprene-Styrene | Toluene | 1.40 | 45 |
| 6 | KRATON ™ D1114P | Styrene-Isoprene-Styrene | Toluene | 0.95 | 42 |
| 7 | KRATON ™ D1164P | Styrene-Isoprene-Styrene | Toluene | 0.81 | 53 |
| 8 | KRATON ™ D1171P | Styrene-Isobutylene-Styrene | Toluene | 1.55 | 45 |
| 9 | KRATON ™ D1116K | Styrene-Butadiene-Styrene | Toluene | 0.90 | 63 |
| 10 | KRATON ™ D1118K | Styrene-Butadiene-Styrene | Toluene | 0.46 | 74 |
| 11 | KRATON ™ D1340K | Styrene-Butadiene-Styrene | Toluene | 1.76 | 29 |
| 12 | KRATON ™ MD6700G | Styrene-Ethylene/Butylene-Styrene | Toluene | 0.68 | |
| 13 | QUINTAC ™ 3620 | Styrene-Isoprene-Styrene | Toluene | 1.90 | 28 |
| 14 | VECTOR ™ 8508A | Styrene-Butadiene-Styrene | Toluene | 0.90 | 65 |
| 15 | VECTOR ™ + QUINTAC ™ | 50:50 Blend | Toluene | 1.37 | 48 |
| 16 | LUBRIZOL ™ ESTANE ™ 58213 | Polyurethane Elastomer | Blend | 1.56 | |
| 17 | LUBRIZOL ™ ESTANE ™ X1393 | Polyurethane Elastomer | Blend | 1.76 | |
| 18 | SBR Rubber | Styrene-Butadiene | Toluene | 0.56 | |
| 19 | NORDEL ™ EPDM 4570 Rubber | Ethylene Propylene Diene | Toluene | 1.81 | |
| 20 | HUNTSMAN ™ IROGRAN ™ 160E-4902 | Polyurethane Elastomer | Blend | >2.0 | |

Example 21

In an effort to determine if coating weight had an effect on the COF of the coated looped pile fabric, Example 11 was repeated, except that the coating solution contained only 2% by weight of the KRATON™ D1340K. The measured COF was 0.67, higher than that of uncoated Example 4, but much lower than that of Example 11.

Examples 22 to 34

Because there is a significant difference in tension as a film passes over them on a film line, pull rollers (or drive rollers) are believed to be the largest source of roller-induced scuffing and scratching. In order for a film to transport over a pull roller without slipping (and thus avoid risk being scratched, the, the static COF for engagement cover the film on the roll must be equal to or greater than the value predicted by the Belt Equation noted above The static COF is preferably close to but higher than the dynamic (sliding) COF. Calculations indicated that for most pull roller tensions experienced in commercial web-handling lines, and for most wrap angles commonly used, static COF of about 1.0 or greater would be needed for an optimally performing looped pile fabric engagement cover. Many of the Examples in Table 2 exhibit such high COFs against PET film.

Materials of the present invention were tested on a laboratory film transport apparatus comprising an unwind, a load cell, tension control roller, a pull roller, idler rollers, and a winder roller. The idler rolls were configured such that when the film was threaded so as to pass over them on the way to the winder from the pull roller, the pull roller wrap angle was 150°, and when the film was threaded so as to bypass them on the way to the winder from the pull roll, the pull roller wrap angle was 50°.

For Examples 27 to 30, a specimen of looped pile stock material PET-HS4 was coated with VECTOR™ 8508A out of a 10% solution in toluene by a continuous dip and nip process similar to that described in U.S. Pat. No. 6,017,831. Essentially, the roll cover stock was dipped into the polymer solution bath, removed, run through nip rollers to express the bulk of the excess solution, and then dried in an oven at 100° C. For Examples 31 to 34, another specimen of PET-HS4 was coated with KRATON™ D1340K by an identical process.

The film run through the laboratory film transport apparatus was a 20 inch wide biaxially oriented PET which had been coated on one side with a primer that lowered the COF of the film on that side.

For Example 22, the film was run through the laboratory film transport apparatus with the uncoated side of the PET film in contact with the 3.5 inch diameter aluminum pull roller at a 150° wrap angle. The film was run at about 15 feet/minute (460 cm/minute) and the tension was adjusted slowly upward until the film began to slip on the pull roller. The tension at that point was recorded, and the PLI (pounds force per lineal inch) and static coefficient of friction were calculated. Also, a coupon made of the same aluminum as the pull roll was obtained, and its dynamic COF against PET film was measured in the IMASS tester as described previously in Example 3. The results are shown in Table 3.

For Examples 23 to 26, the pull roll was covered with a sleeve of the uncoated PET-HS4 looped pile fabric. The PET film was run through the laboratory film transport apparatus in all four permutations derived from coated side down vs. uncoated side down, and 50° wrap angle vs. 150° wrap angle using procedures otherwise identical to those of Example 22. Rectangular swatches of the PET-HS4 looped pile fabric were cut, and tested for dynamic COF against each side of the PET film, by procedures already described. The results are shown in Table 3.

For Examples 27 to 30, the pull roller was covered with a sleeve of the PET-HS4 looped pile fabric that had been coated with VECTOR™ 8508A. The PET film was run through the laboratory film transport apparatus in all four permutations derived from coated side down vs. uncoated side down, and 50° wrap angle vs. 150° wrap angle using procedures otherwise identical to those of Example 22. Rectangular swatches of the PET-HS4 looped pile fabric coated with VECTOR™ 8508A were cut, and tested for dynamic COF against each side of the PET film, by procedures already described. The results are shown in Table 3.

For Examples 31 to 34, the pull roll was covered with a sleeve of the PET-HS4 looped pile fabric that had been coated with KRATON™ D1340K. The PET film was run through the laboratory film transport apparatus in all four permutations derived from coated side down vs. uncoated side down, and 50° wrap angle vs. 150° wrap angle using procedures otherwise identical to those of Example 22. Rectangular swatches of the PET-HS4 looped pile fabric coated with KRATON™ D1340K were cut, and tested for dynamic COF against each side of the PET film, by procedures already described. The results are shown in Table 3.

TABLE 3

| Ex. No. | Roller Surface | Film Side | Wrap Angle (degrees) | Tension at Slip (psi) | PLI (lbs) | Static COF | Dynamic COF |
|---|---|---|---|---|---|---|---|
| 22 | Aluminum | Uncoated | 150 | 18 | 0.9 | 0.32 | 0.26 |
| 23 | PET-HS4 | Coated | 50 | 3 | 0.15 | 0.22 | 0.4 |
| 24 | PET-HS4 | Coated | 150 | 21 | 1.05 | 0.35 | 0.4 |
| 25 | PET-HS4 | Uncoated | 50 | 16 | 0.8 | 0.87 | 0.6 |
| 26 | PET-HS4 | Uncoated | 150 | 44 | 2.2 | 0.54 | 0.6 |
| 27 | VECTOR ™ 8508A | Coated | 50 | 24 | 1.2 | 1.2 | 0.62 |
| 28 | VECTOR ™ 8508A | Coated | 150 | 70 | 3.5 | 1.45 | 0.62 |
| 29 | VECTOR ™ 8508A | Uncoated | 50 | 38 | 1.9 | 1.5 | 0.86 |
| 30 | VECTOR ™ 8508A | Uncoated | 150 | >100 | >5 | >0.8 | 0.86 |
| 31 | KRATON ™ D1340K | Coated | 50 | >100 | >5 | >2.2 | 1.36 |
| 32 | KRATON ™ D1340K | Coated | 150 | >100 | >5 | >0.8 | 1.36 |
| 33 | KRATON ™ D1340K | Uncoated | 50 | >100 | >5 | >2.2 | 1.76 |
| 34 | KRATON ™ D1340K | Uncoated | 150 | >100 | >5 | >0.8 | 1.76 |

One can see that even in the best scenario, i.e., the less-slippery uncoated side of the film in contact with the pull roller at a high wrap angle of 150°, the bare aluminum roller was unable to handle even 1.0 PLI without slippage. Equipping the roller with the uncoated PET-HS4 looped pile fabric engagement cover allowed the pull roller to generate 2.2 PLI at the same condition. Coating the PET-HS4 engagement cover with VECTOR™ 8508A allowed the pull roller to generate greater than 5.0 PLI at the same condition. However, the pull roller covered with that engagement cover performed less well in the less forgiving scenarios of slippier film, lower wrap angle, or both. Coating the PET-HS4 engagement cover with KRATON™ D1340K allowed the pull roller to generate greater than 5.0 PLI in all four scenarios.

In a film making, film coating, or film converting line, such high tensions may be necessary, and the appropriately coated engagement cover can enable operation without slip on the pull roller. One can also see from Table 3 that the dynamic coefficient of friction gave a reasonable prediction of the performance.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

All patents and patent applications cited herein are incorporated by reference in their entirety.

What is claimed is:

1. A method for conveying a web comprising:

(a) providing a web material wherein said web is an optical grade film selected from the group consisting of polyester, copolyesters, and combinations thereof;

(b) providing at least one roller having an engagement cover comprising a resilient looped pile engagement surface wherein said engagement surface is a knit fabric comprising a woven base layer having first and second faces and a resilient looped pile protruding from said first face, and wherein said looped pile has a loop height of from about 0.4 to about 0.8 mm, one loop per stitch, and at least 25 stitches per inch, and comprises fibers having a denier of between about 100 and about 500;

(c) configuring said web material into passing configuration; and (d) passing said web through engaging contact with said engagement surface.

2. The method of claim 1 wherein said engagement surface is on a removable sleeve on said roller.

3. The method of claim 2 wherein said sleeve is a knitted fabric comprising a ground layer and a looped pile.

4. The method of claim 1 wherein said looped pile comprises a fibrous material selected from the group consisting of poly(tetrafluoroethylene), aramid, polyester, polypropylene, nylon, or a combinations thereof.

5. The method of claim 1 wherein said roller has two or more engagement covers mounted in concentric arrangement thereon.

6. The method of claim 1 wherein said looped pile has a loop height of from about 0.5 to about 0.7 mm.

7. The method of claim 1 wherein said looped pile has a one loop thread per stitch.

8. The method of claim 1 wherein said web material is provided in roll form and configuring said web material into passing configuration comprises unrolling said web material.

9. The method of claim 1 wherein said web material is extruded or cast in line to be configured into said passing configuration without having been wound into roll form.

10. The method of claim 1 wherein said web material is provided in sheet form.

11. The method of claim 1 comprising passing said web around two or more rollers.

12. The method of claim 1 wherein two or more of said rollers have an engagement cover thereon.

13. The method of claim 1 wherein two or more of said rollers each have multiple engagement covers thereon.

14. The method of claim 1 wherein said loop pile has a coefficient of friction from about 0.25 to about 2.0 with said web material.

15. The method of claim 1 wherein the web is passed through engaging contact with said engagement surface at a speed of 100 feet/minute or more.

16. The method of claim 1 wherein the web is passed through engaging contact with said engagement surface at a speed of 150 feet/minute or more.

17. An apparatus, the apparatus comprising a web wherein the web is an optical film selected from the group consisting of polyester, copolyesters, and combinations thereof, and a roller comprising a core and a resilient looped pile engagement cover comprising a resilient looped pile engagement surface wherein said engagement surface is a knit fabric comprising a woven base layer having first and second faces and a resilient looped pile protruding from said first face, and wherein said looped pile has a loop height of from about 0.4 to about 0.8 mm, one loop per stitch, and at least 25 stitches per inch, and comprises fibers having a denier of between about 100 and about 500.

* * * * *